US011548136B2

(12) United States Patent
Stewart et al.

(10) Patent No.: US 11,548,136 B2
(45) Date of Patent: Jan. 10, 2023

(54) ARTICULATING ASSEMBLIES FOR CLEANING TOOLS AND METHODS OF USE

(71) Applicant: Micronova Manufacturing, Inc., Torrance, CA (US)

(72) Inventors: Kristin Stewart, Harbor City, CA (US); Phillip LeCompte, Anaheim, CA (US)

(73) Assignee: MICRONOVA MANUFACTURING, INC., Torrance, CA (US)

( * ) Notice: Subject to any disclaimer, the term of this patent is extended or adjusted under 35 U.S.C. 154(b) by 326 days.

(21) Appl. No.: 16/791,867

(22) Filed: Feb. 14, 2020

(65) Prior Publication Data

US 2020/0180136 A1 Jun. 11, 2020

Related U.S. Application Data

(62) Division of application No. 14/777,439, filed as application No. PCT/US2014/026611 on Mar. 13, 2014, now Pat. No. 10,562,173.

(60) Provisional application No. 61/801,198, filed on Mar. 15, 2013.

(51) Int. Cl.

| | |
|---|---|
| ***B25G 3/38*** | (2006.01) |
| ***A47L 13/254*** | (2006.01) |
| ***A47L 13/24*** | (2006.01) |
| ***A46B 5/00*** | (2006.01) |
| ***B25G 3/02*** | (2006.01) |

(52) U.S. Cl.

CPC ..... *B25G 3/38* (2013.01); *A46B 5/0058* (2013.01); *A47L 13/24* (2013.01); *A47L 13/254* (2013.01); *B25G 3/02* (2013.01)

(58) Field of Classification Search

CPC ..... A47L 13/24; A47L 13/254; A46B 5/0058; B25G 3/38

See application file for complete search history.

(56) References Cited

U.S. PATENT DOCUMENTS

| | | | |
|---|---|---|---|
| 509,884 | A * | 12/1893 | Faber |
| 2,899,225 | A | 8/1959 | Birr |
| 5,876,141 | A | 3/1999 | Hsu |
| 7,343,638 | B2 | 3/2008 | Mitchell et al. |
| 9,486,060 | B1 | 11/2016 | Cara |
| 10,562,173 | B2 | 2/2020 | Stewart et al. |
| 2005/0060827 | A1 | 3/2005 | James et al. |
| 2011/0083535 | A1 | 4/2011 | Su |

(Continued)

FOREIGN PATENT DOCUMENTS

| | | |
|---|---|---|
| CA | 2743814 | 9/2011 |
| EP | 2967273 | 11/2017 |
| JP | 2005-081064 A | 3/2005 |

(Continued)

OTHER PUBLICATIONS

Park, Hye Lyun, International Search Report, dated Jul. 24, 2014, 4 pages, Korean Intellectual Property Office, Daejeon Metropolitan City, Republic of Korea.

(Continued)

*Primary Examiner* — Randall E Chin

(74) *Attorney, Agent, or Firm* — Henricks Slavin LLP

(57) ABSTRACT

An adapter and method for a tool, a mop or other cleaning equipment provides, selectively, a universal joint or pivoting joint, and one that is easily adjustable.

23 Claims, 9 Drawing Sheets

(56) References Cited

U.S. PATENT DOCUMENTS

| | | | |
|---|---|---|---|
| 2014/0026342 | A1 | 1/2014 | Pant |
| 2016/0031073 | A1 | 2/2016 | Stewart et al. |

FOREIGN PATENT DOCUMENTS

| | | | | |
|---|---|---|---|---|
| JP | 2006-238982 | A | | 9/2006 |
| JP | 2008-295955 | A | | 12/2008 |
| JP | 2010-264096 | A | | 11/2010 |
| WO | WO 2004/080267 | A1 | * | 9/2004 |
| WO | WO 2014/151882 | | | 9/2014 |

OTHER PUBLICATIONS

Park, Hye Lyun, Written Opinion of the International Search Authority, dated Jul. 24, 2014, 7 pages, Korean Intellectual Property Office, Daejeon Metropolitan City, Republic of Korea.

Dewaele, Karl, Extended European Search Report, dated Sep. 2, 2016, 10 pages, European Patent Office, Munich, Germany.

* cited by examiner

ARTICULATING ASSEMBLIES FOR CLEANING TOOLS AND METHODS OF USE

CROSS REFERENCE TO RELATED APPLICATIONS

This application is a divisional of Ser. No. 14/777,439 filed Sep. 15, 2015, now U.S. Pat. No. 10,562,173 issued Feb. 18, 2020, which is a National Stage of International Application No. PCT/US14/26611, filed Mar. 13, 2014, published as WO2014/151882, which claims priority to U.S. Provisional Application No. 61/801,198, filed Mar. 15, 2013, now expired. The disclosures of each of the aforementioned applications and publications are incorporated herein by reference thereto.

BACKGROUND

Field

This relates to tools with working and control components, for example mops, mops with mop handles and mop elements, components therefore, and adjustable universal joints therefore.

SUMMARY

In one example of an adapter for mops, mop assemblies and other cleaning tools, and the like, which may provide a universal joint, for example, a configurable universal joint is disclosed. In one configuration, the configurable universal joint allows for relative movement of a mop handle and mop head through substantially 360°, in an approximate hemisphere. In one example, the handle can move relative to the mop head through a circle of 360°, and through continuous series of arcs, for example through 180 degrees, from one side of the mop head to the other, and vice versa with respect to the head relative to the handle. In one example, pivoting motion of a mop handle and a mop head relative to each other may occur about a first axis, and pivoting motion of the mop handle and the mop head relative to each other may also occur about a second axis. In one example, the first and second axes do not intersect.

In another example of a tool having a working portion, for example a mop head, and a control portion, for example a handle, the working and control portions are coupled together with a coupler that allows for relative movement between the two. The coupler includes a first portion for controlling and allowing relative movement about a first axis, and a second portion for controlling and allowing relative movement about a second axis. In one example, the first and second axes extending perpendicular directions, and may be contained in different planes. Movement about the axes can be controlled for example by the coupler for the movement occurs about only one axis or the other, or both. In one configuration, movement about one or both axes can be controlled by loosening or tightening one or more fitting configurations, for example loosening or tightening the fit around an axle or cylinder defining one axis, and/or loosening or tightening the fit around another axle or cylinder, or around a disc portion. Also in one configuration, the coupler can be a U-shaped bracket having sidewalls for receiving part of the control portion, and wherein the sidewalls are joined by a bottom portion. The sidewalls can receive and allow the part of the control portion to pivot between the sidewalls, or the sidewalls can fix the part of the control portion in place relative to the sidewalls. The sidewalls can fix the part of the control portion in a number of ways, including one or more fasteners, interfitting structures, latches, or other means. The bottom portion may receive and allow part of the working portion to pivot within the bottom portion of the bracket.

In a further example of a tool having a working portion, for example a mop head, and a control portion, for example a handle, the working and control portions may be joined by a U-shaped bracket having sidewalls wherein facing surfaces of the sidewalls have surfaces or contours for interfacing with a portion of the handle extending between the sidewalls. In one example, the surfaces or contours are complementary to corresponding surfaces or contours on the handle portion, and in another example, surfaces or contours on one of the sidewalls or the handle allow pivoting of the handle relative to the sidewalls and other surfaces or contours on another portion of either the sidewalls or the handle limit or prevent pivoting of the handle relative to the sidewalls. In one configuration, one of the sidewalls and part of the handle have surfaces or contours, for example flats, corners or other similar contours, that limit or prevent pivoting of the handle relative to the bracket. In another configuration, one of the sidewalls and one of the handle surfaces have surfaces or contours complementary to each other and that are flats, corners or other similar contours that would prevent pivoting or rotation, when the complementary surfaces engage each other, and when the complementary surfaces do not engage each other, for example when the complementary surface on the handle faces the other side wall, the handle can pivot relative to the bracket. In a further configuration, one of the sidewalls and one of the handle surfaces have surfaces or contours complementary to each other that, when engaged, limit or prevent rotation, and the other of the sidewalls and another of the handle surfaces or contours are complementary to each other and allow arcuate sliding relative to each other. In this latter example in the immediately preceding sentence, the handle orientation can be changed so that the arcuate sliding surface on the handle can engage the sidewall surfaces that otherwise limit or prevent rotation, in which orientation the handle can freely pivot relative to the bracket.

Another example of a configurable universal joint for mop assemblies and other cleaning tools includes a component shifting or adjustment configuration universal joint in which a shift or adjustment in the component changes the universal joint from a first configuration to a second configuration. In one example, the first configuration provides for substantially 360° movement of a mop handle and mop head, for example, in or through a hemisphere. In another configuration, the component is adjusted and, for example, the universal joint is restricted to the universal joint permitting motion of the mop handle and mop head relative to each other through 180° but only in a single plane. In a further example, pivoting is changed from two axes to one axis. In one example, such a reconfiguration can be accomplished by simple removal and repositioning of a component.

In a further example of a configurable universal joint for mop assemblies and other working tools controlled by a handle, universal joint may have sidewalls, one of which includes a rectilinear or other flat-sided structure and the other of which includes a circular or arcuate structure. The sidewalls may be joined by a lower portion having an arcuate surface for engaging and pivoting about an axle or other structure, for example on a mop head or other working tool.

In another example, an adjustment mechanism is provided for the adapter. In one example, the adjustment can be carried out through one component, for example a fastener. In another example, adjustment can be made simultaneously to two different functions. Examples of two different functions include ease or looseness of pivoting about two different axes.

In any of the examples described herein, surfaces on the sidewalls of the U-bracket or universal joint can be interchanged with their complementary surfaces on the handle portion. Additionally, structures or contours on facing surfaces of the U-bracket sidewalls can be placed on outside surfaces of the sidewalls and a single structure on a handle portion can engage one side or the other of the outside of the sidewalls, or a U-bracket structure on the handle portion can fit around and engage the outside sidewalls of the U-bracket and allow or restrict pivoting using surfaces such as those described herein.

In a mop handle and mop head assembly coupled together with a coupler, a first orientation of the handle in the coupler allows relative pivoting between the handle and the coupler, and changing the orientation of the handle in the coupler to a second configuration limit or prevent relative pivoting between the handle and the coupler. In one example, an arcuate surface on the handle portions can pivot around the flat surfaces on a side wall of the coupler while flat sidewalls on the handle can pivot around arcuate surfaces on a side wall of the coupler. The handle is then reversed so that the flat side of the handle portion engages the flat sides of the sidewall, limiting or preventing pivoting of the handle relative to the coupler. In another example of a handle and coupler configuration, a fastener can be used to tighten or loosen the coupler, to limit or free up relative pivoting between the handle and the coupler. For example, loosening the fastener will loosen the coupler and allow easier relative pivoting between the coupler and the handle. Tightening the fastener will tighten the coupler and make relative pivoting between the coupler and the handle more difficult. Additionally, the fastener can be used to tighten or loosen the coupler to limit or free up relative pivoting not only between the coupler and a handle, but also between the coupler and a working tool such as a mop head. In one example, the coupler is configured to fit around an axle on a mop head with a friction fit so that a positive load is required to provide relative pivoting between the mop head and the coupler, even though the load may be relatively small. At the same time, a coupling between the coupler and a handle portion can be loose so that the mop head and handle can easily pivot relative to each other, or can have a friction fit so that a positive load is required to produce relative pivoting between the coupler and the handle, even if the load may be relatively small. Thereafter, tightening a fastener, for example a single fastener, increases the frictional engagement between the coupler and the axle and/or the coupler and the handle portion, so that additional loading is required to produce relative pivoting between the coupler and the respective structure (working tool or handle portion). Further tightening increases the frictional engagement, while loosening decreases the frictional engagement.

These and other examples are set forth more fully below in conjunction with drawings, a brief description of which follows.

DETAILED DESCRIPTION

This specification taken in conjunction with the drawings sets forth examples of apparatus and methods incorporating one or more aspects of the present inventions in such a manner that any person skilled in the art can make and use the inventions. The examples provide the best modes contemplated for carrying out the inventions, although it should be understood that various modifications can be accomplished within the parameters of the present inventions.

Examples of tools and of methods of making and using the tools are described. Depending on what feature or features are incorporated in a given structure or a given method, benefits can be achieved in the structure or the method.

These and other benefits will become more apparent with consideration of the description of the examples herein. However, it should be understood that not all of the benefits or features discussed with respect to a particular example must be incorporated into a tool, component or method in order to achieve one or more benefits contemplated by these examples. Additionally, it should be understood that features of the examples can be incorporated into a tool, component or method to achieve some measure of a given benefit even though the benefit may not be optimal compared to other possible configurations. For example, one or more benefits may not be optimized for a given configuration in order to achieve cost reductions, efficiencies or for other reasons known to the person settling on a particular product configuration or method.

Examples of a number of tool configurations and of methods of making and using the tools are described herein, and some have particular benefits in being used together. However, even though these apparatus and methods are considered together at this point, there is no requirement that they be combined, used together, or that one component or method be used with any other component or method, or combination. Additionally, it will be understood that a given component or method could be combined with other structures or methods not expressly discussed herein while still achieving desirable results.

Cleaning tools are used as examples of a tool that can incorporate one or more of the features and derive some of the benefits described herein, and in particular mops. Tools other than mops can benefit from one or more of the present inventions.

It should be understood that terminology used for orientation, such as front, rear, side, left and right, upper and lower, and the like, are used herein merely for ease of understanding and reference, and are not used as exclusive terms for the structures being described and illustrated.

Figure 2:
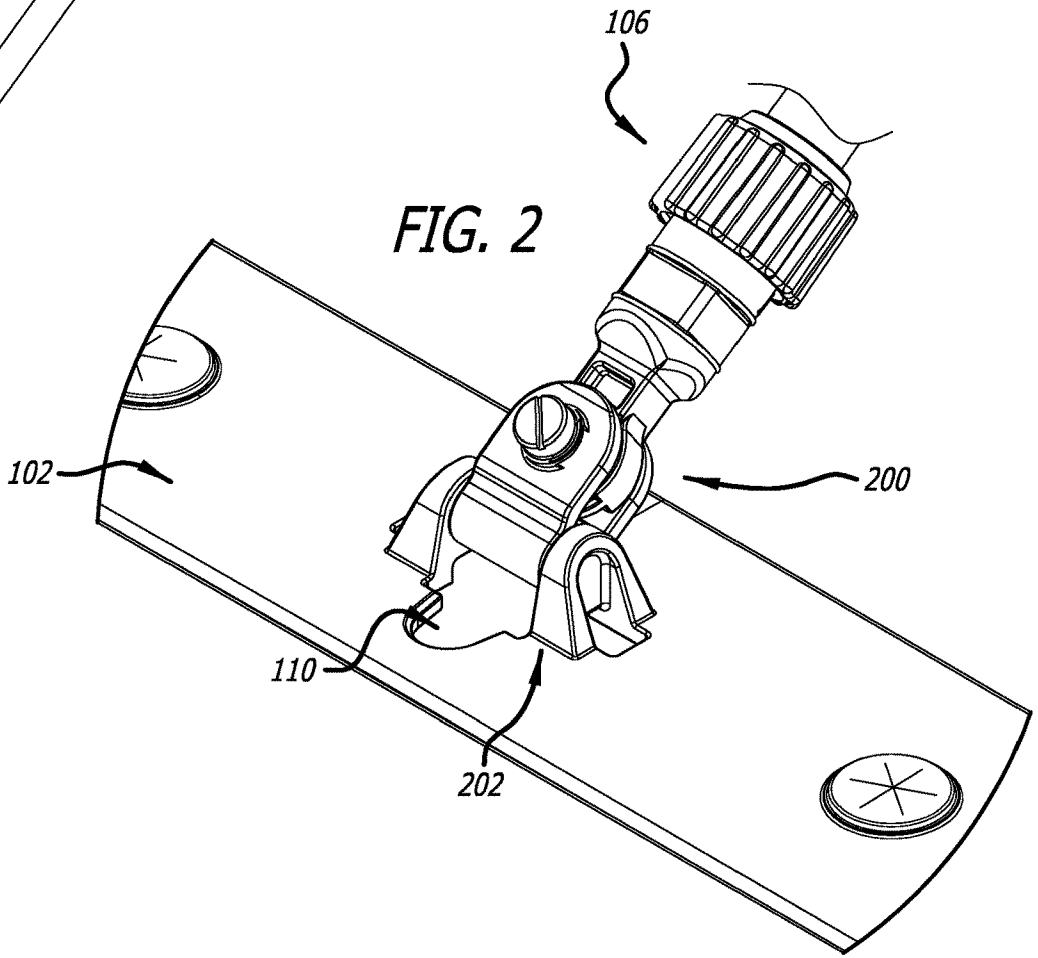
FIG. 2 is a detailed view of part of the assembly of FIG. 1.
Figure 1:
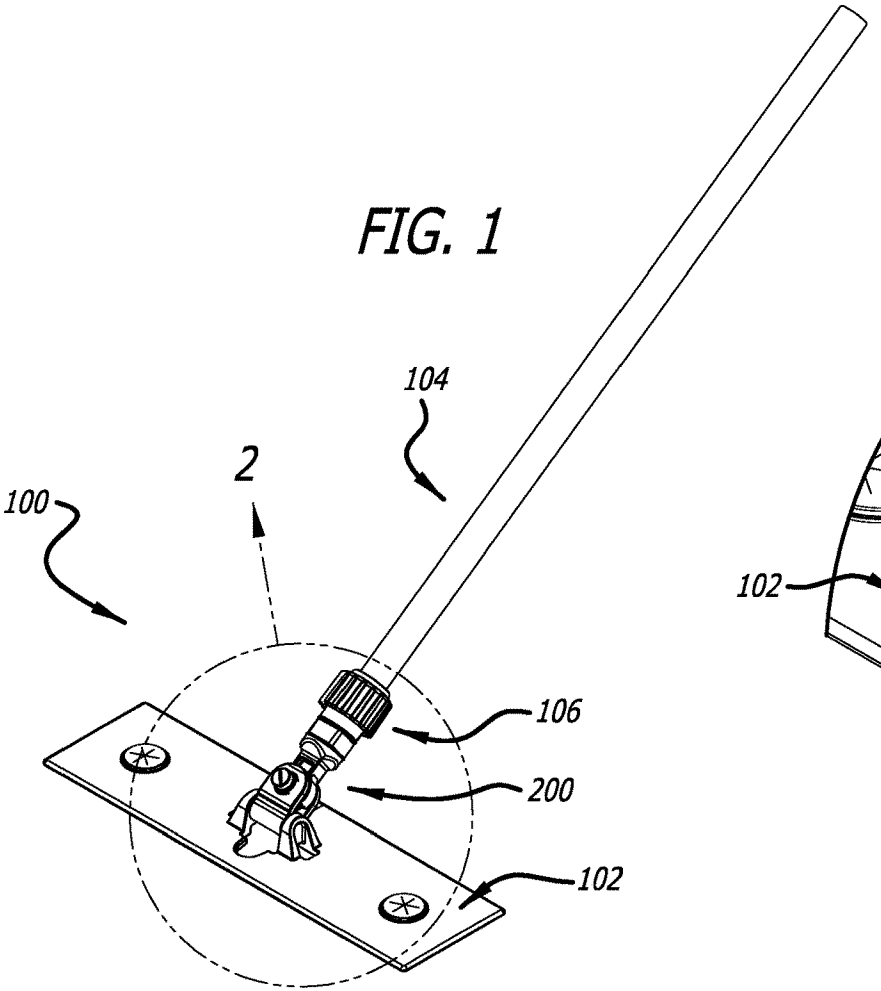
FIG. 1 is an upper right front isometric view of a mop assembly incorporating a configurable universal joint or adapter according to one example disclosed herein.

A mop assembly 100 (FIGS. 1-9) can take a number of configurations. Typically, the mop includes a mop head 102, in the present example a frame or pad support having a rectilinear configuration for supporting a cleaning material (not shown). However, other mop heads can be used with the adapter or universal joint described herein. Mops and other cleaning tools can also have a number of configurations for manipulating or handling the tool. In the present example, a handle 104 is removably secured to the assembly through a threaded collar 106. Other handle configurations may also be used with the adapter disclosed herein. Grommets 108 retain cloth, fabric or other material between the leaves of the grommet. The grommets snap into openings in the mop head. The mop head may also include a U-shaped or other shaped opening or cavity 110 (FIG. 2) for accommodating a head (214 below) or other structural part of a fastener on the adapter, for example so the mop face and the handle can both lie flat or extend in substantially parallel planes.

In the present example, an adapter 200 provides an interface between the mop head 102 and the handle 104. The adapter 200 is an adjustable adapter. In one example, the adapter 200 is adjustable through a single component, such as a screw or bolt, described more fully below. Additionally, in the configuration described herein, the adapter 200 is also reconfigurable from a first configuration to a second configuration.

Figure 5:
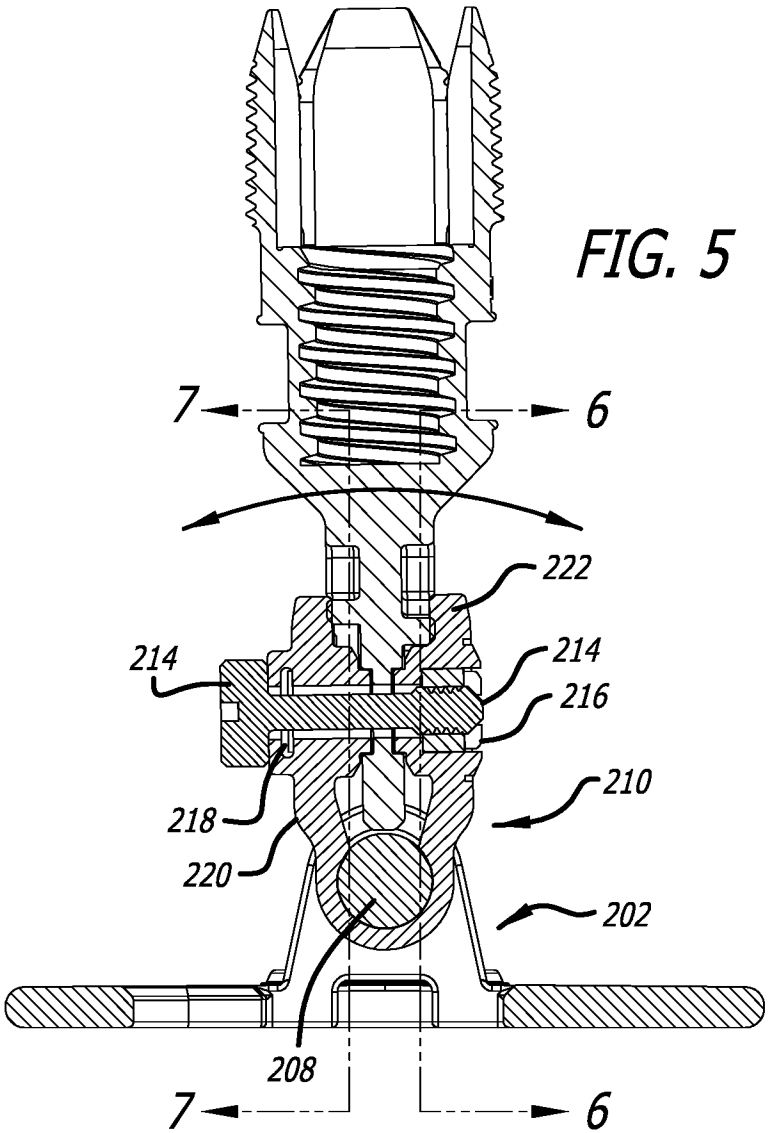
FIG. 5 is a longitudinal cross-section of the assembly of FIG. 4 taken along line 5-5.
Figure 4:
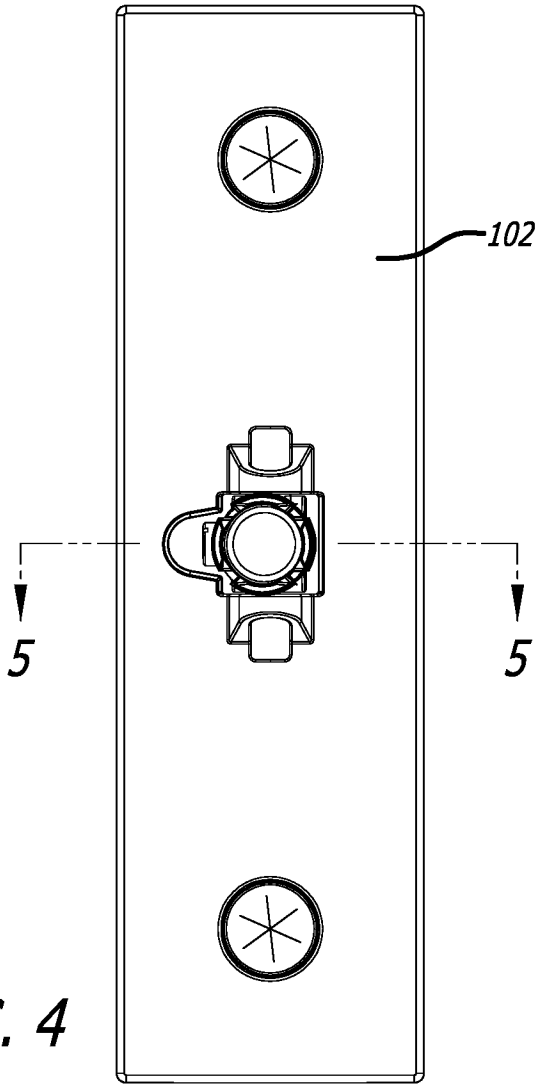
FIG. 4 is a top plan view of a mop frame and adapter assembly of FIG. 1.
Figure 6:
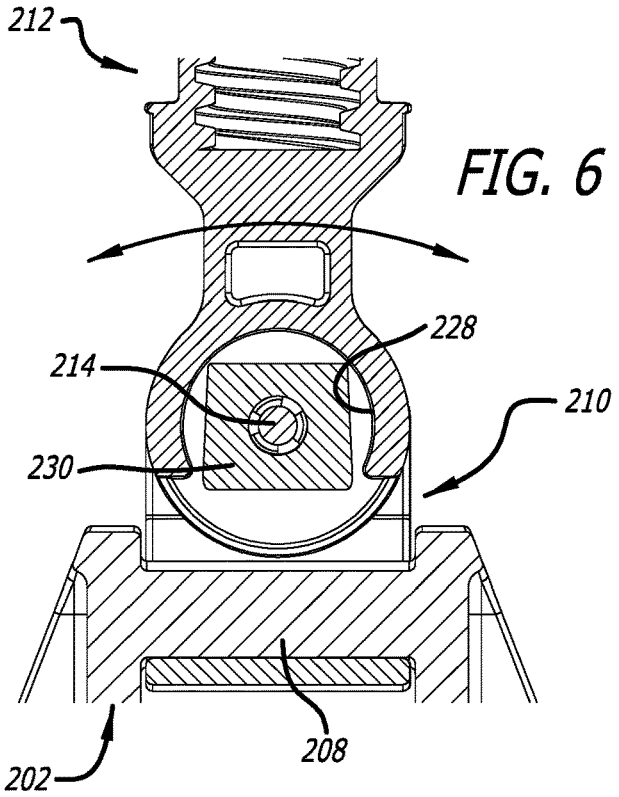
FIG. 6 is a partial sagittal cross-section of FIG. 4 taken along line 6-6 of FIG. 5.

In one exemplary configuration, the adapter 200 is coupled to the mop head by a hub or bracket 202. The bracket is fixed to the mop head by being formed integral or monolithic with the mop head, and includes first and second supports 204 and 206 spaced apart and supporting a pivot axle or shaft 208 (FIG. 5). The rest of the adapter pivots about a longitudinal axis defined by the pivot shaft. The pivot shaft allows the mop head and handle to pivot with respect to each other through an angle of approximately 180°. In other examples, the hub or bracket 202 can be removably secured to the mop head through a number of configurations, for example fasteners, interlocks or in other ways.

The adapter includes a center pivot 210 (FIGS. 1-12). The center pivot 210 is configured to pivot about the pivot shaft 208. The center pivot provides the interface between the mop head 102 and the handle 104 so that the mop head and the handle can pivot through approximately 180° in a vertical plane perpendicular to the mop head. The center pivot 210 also provides support structure to allow pivoting of the handle about an axis transverse (or otherwise) to the pivot shaft 208. Additionally, the center pivot 210 provides means for adjusting the looseness or ease with which the mop head and handle pivot relative to each other. The center pivot 210 further provides surfaces for allowing the adapter to be reconfigured between first and second configurations, for example from a universal joint allowing 360° motion in a hemisphere to a single pivot configuration allowing 180° pivoting movement in a single plane.

The center pivot 210 supports a pole pivot 212. The pole pivot 212 can pivot relative to the center pivot 210 about an axis defined by a fastener 214, and which may be perpendicular to the pivot shaft. The fastener may be fixed so that the pole adapter 212 is permanently attached to the center pivot 210, or the fastener may be removable. In the present example, the fastener 214 is a threaded bolt having a head to be engaged or manually turned for removing and reinserting the bolt in the center pivot and through an opening in the pole pivot 212. In the illustrated example, the fastener 214 threads into and is secured to a nut 216. The fastener includes a reduced-diameter shank between the head and the threaded portion to minimize any interference between the shank and the bore in which it is placed. An E-clip or other retainer 218 keeps the fastener from falling out when it is unthreaded from the nut.

The center pivot includes a front flange 220 and a back flange 222. The fastener 214 can turn within the center pivot and move in and out, while the nut 216 is rotatably captured in the hex cavity in the back flange 222. The nut 216 may also be axially but removably captured in the cavity by detents, interference with one or more surfaces or otherwise so it cannot easily fallout of the cavity when the fastener 214 is disengaged. In the present configuration of the center pivot, the fastener can be used to tighten and loosen the pivot motion of the center pivot about the pivot shaft 208. The fastener can also be used to tighten and loosen the pivot motion of the handle relative to the center pivot by tightening or loosening the fastener. Additionally, the fastener can be used to release the pole pivot and change the configuration of the adapter from a first configuration to a second configuration. Alternatively, a fixed fastener such as a rivet can secure the pole pivot to the center pivot in one or the other of the configurations.

The pole pivot 212 includes a structure 224, in the present example a shaft, for supporting the pole 104. The shaft includes a threaded portion for receiving the collar 106 for securing the pole within the shaft. The pole pivot 212 includes a mounting portion 226 for engaging the center pivot 210. In one configuration of the pole pivot in the center pivot, the pole pivot can pivot through 180° about the axis of the fastener 214. In another configuration, the pole pivot is rotationally locked or fixed relative to the center pivot.

Figure 7:
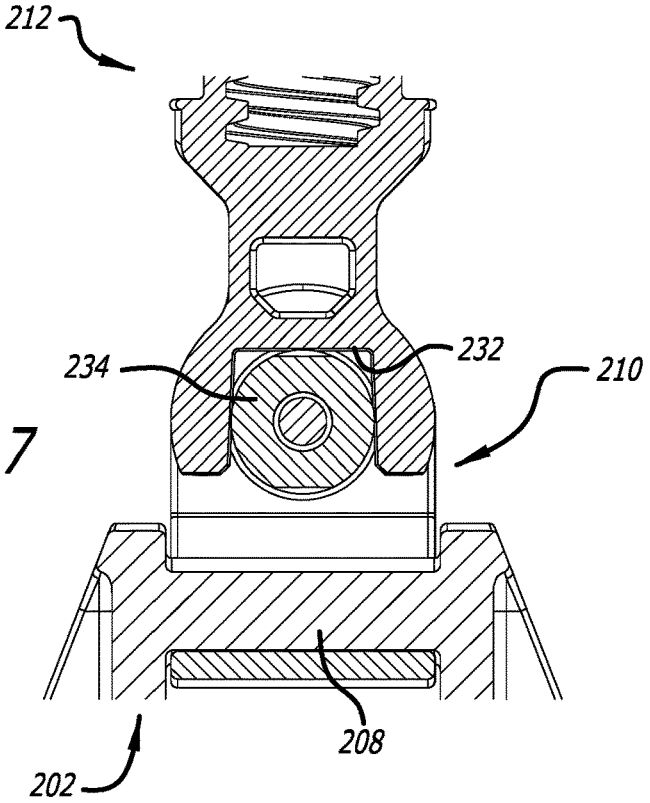
FIG. 7 is a partial sagittal cross-section of FIG. 4 taken along line 7-7 of FIG. 5.
Figure 8:
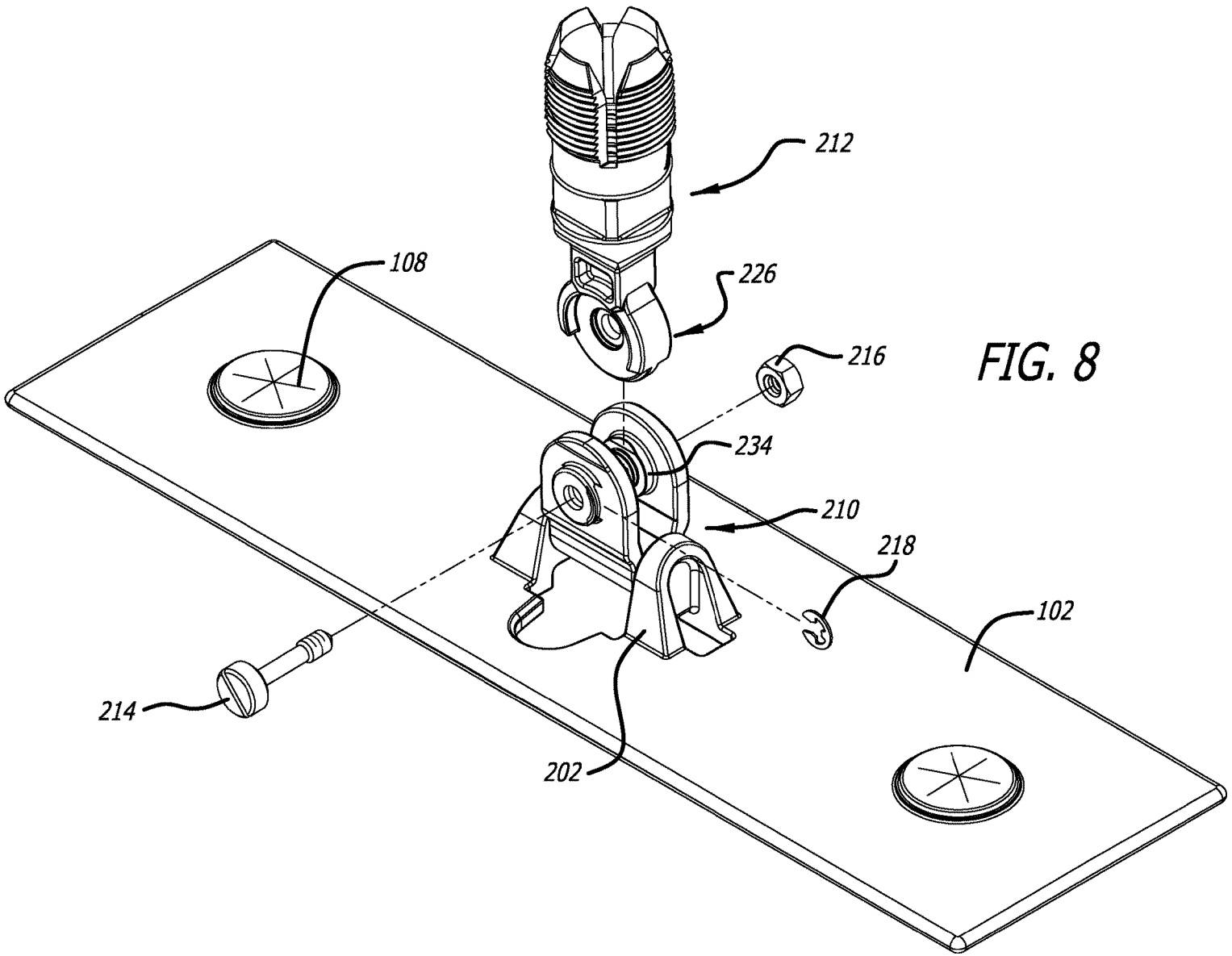
FIG. 8 is an upper right front isometric and exploded view of part of the assembly of FIG. 1.
Figure 9:
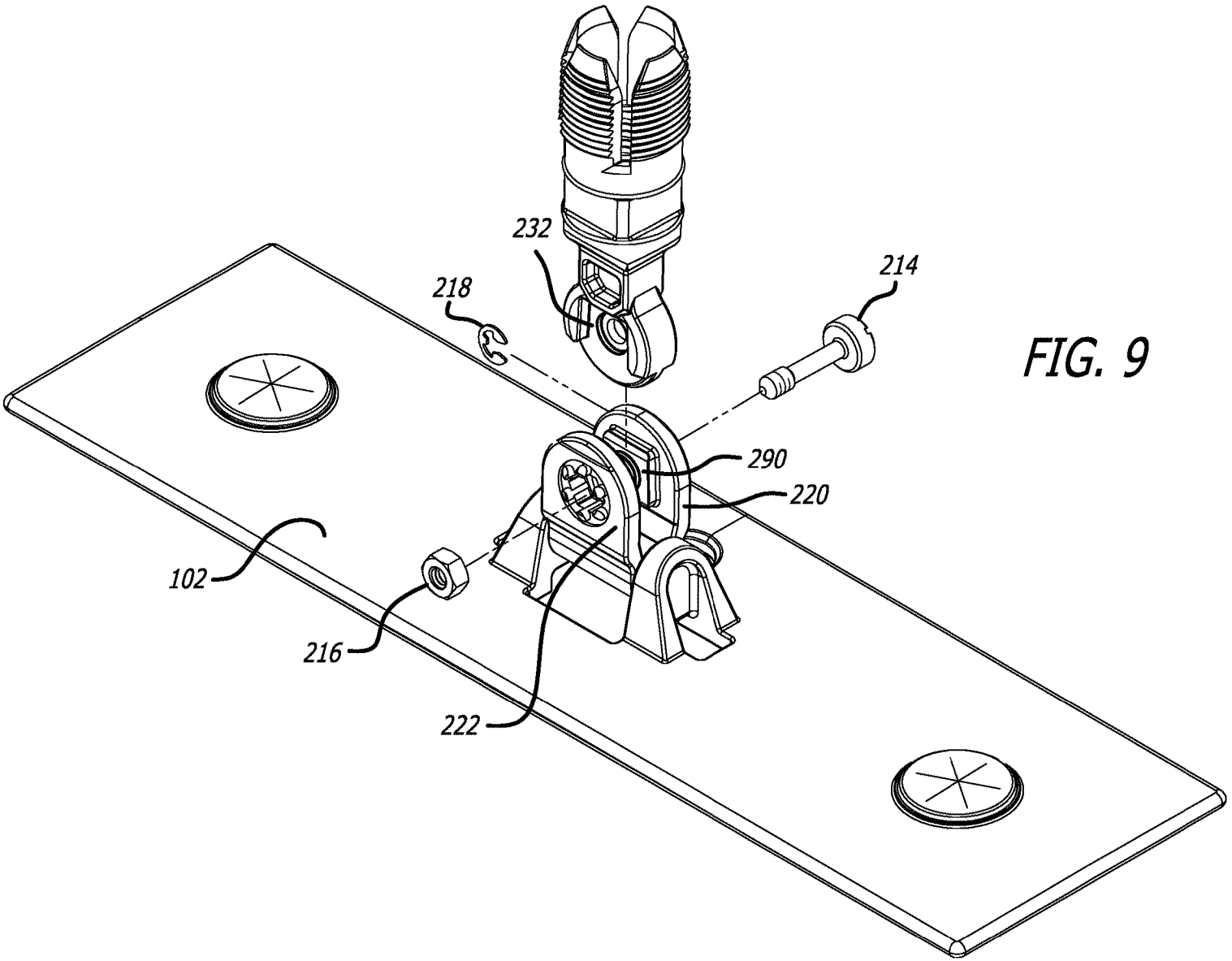
FIG. 9 is an upper right back isometric and exploded view of part of the assembly of FIG. 1.
Figure 12:
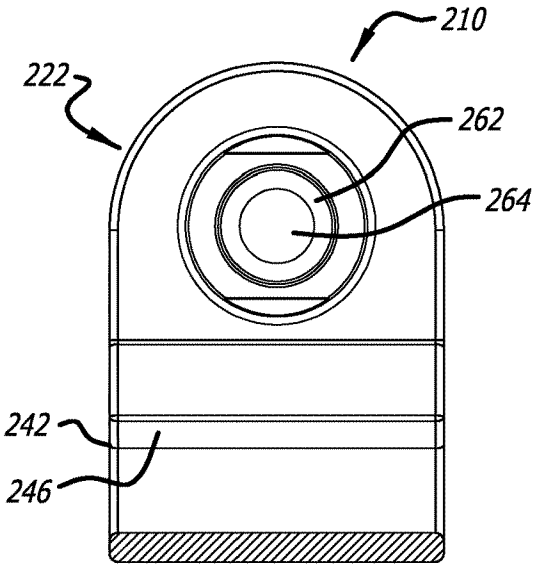
FIG. 12 is a vertical section through the center pivot taken along line 12-12 of FIG. 10.
Figure 11:
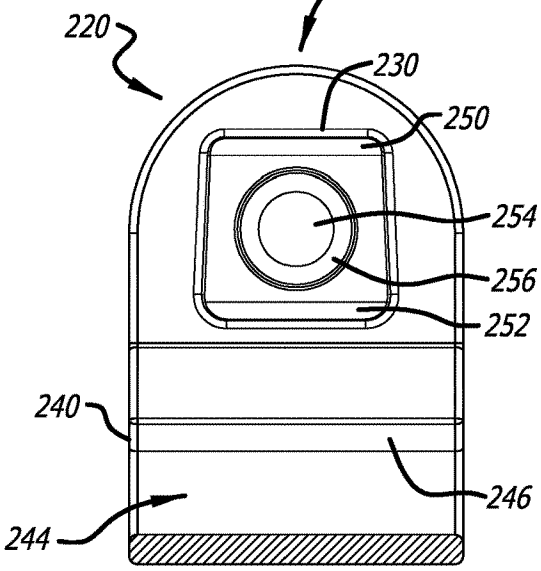
FIG. 11 is a vertical section through the center pivot taken along line 11-11 of FIG. 10.
Figure 10:
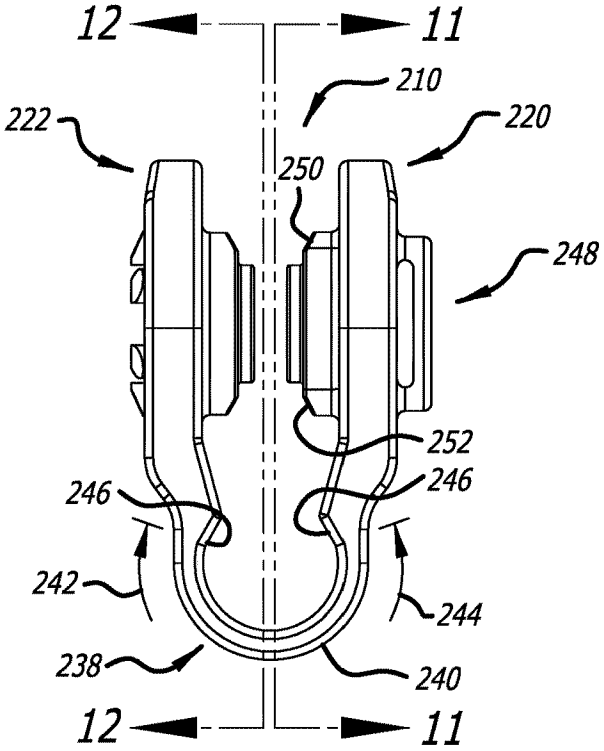
FIG. 10 is a side elevation view of a center pivot, part of the adapter of FIG. 1.

In the illustrations of the assembly shown in FIGS. 1-9, the adapter is configured as a full universal joint allowing relative pivoting motion between the mop head and handle throughout a hemisphere above the mop head, 360° over the top face of the mop head. An arcuate cavity 228 on one exterior side of the pole pivot 212 fits over a noncircular boss 230 on the center pivot (FIG. 6), allowing the pole pivot to slide over the surface of the noncircular boss 230. Additionally, a non-circular cavity 232 on the opposite exterior side of the pole pivot fits over a circular boss 234 on the center pivot (FIG. 7). In this configuration, the surfaces of the pole pivot easily rest on the adjacent surfaces on the center pivot, and the pole pivot can easily pivot relative to the center pivot, about an axis defined by the fastener 214. The parts are fully supported, but pivot freely from side to side.

Figure 15:
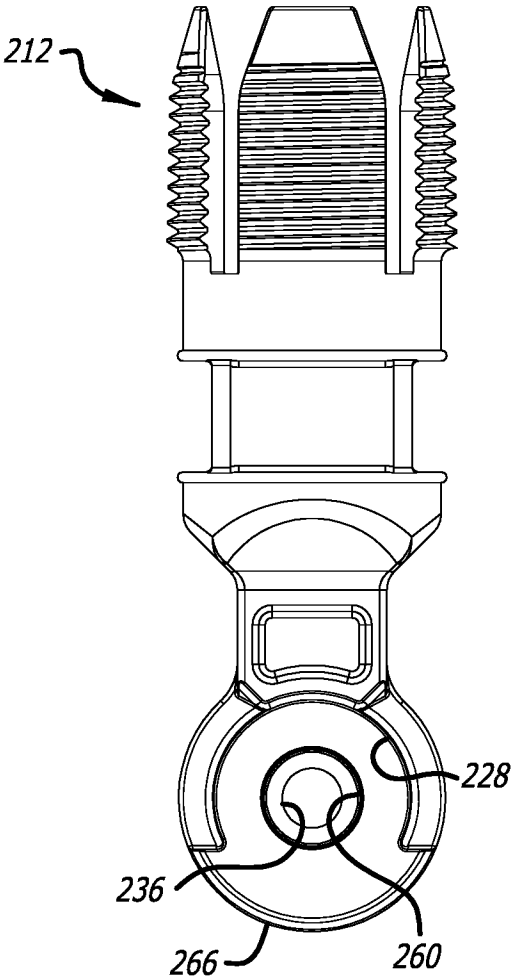
FIG. 15 is a right side elevation view of the pole pivot of FIG. 13.
Figure 14:
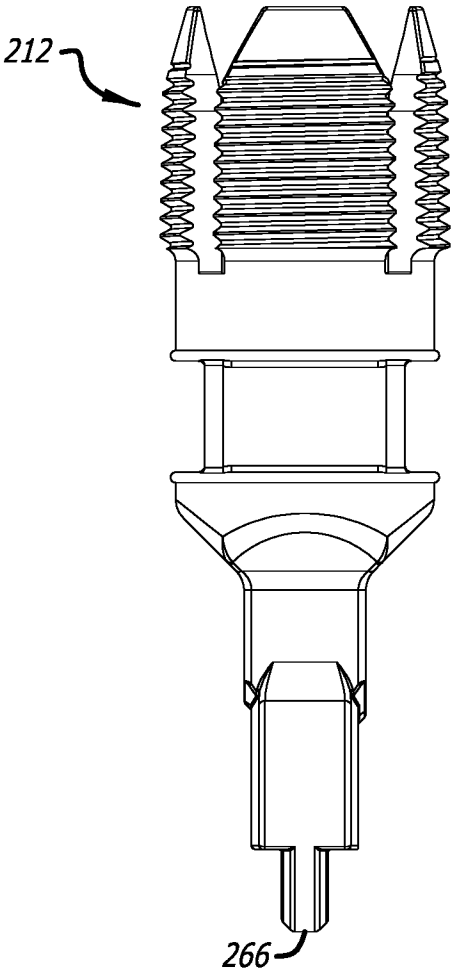
FIG. 14 is a front elevation view of the pole pivot of FIG. 13.
Figure 13:
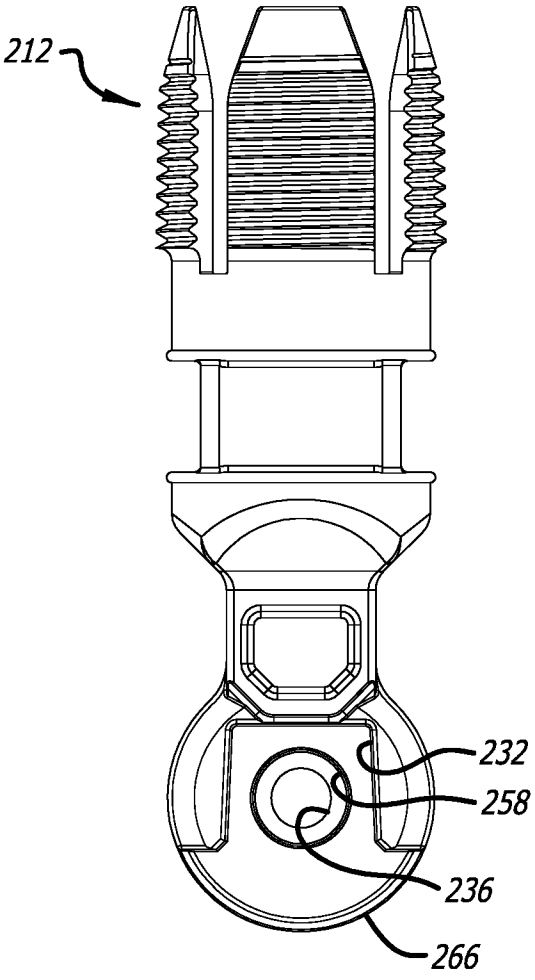
FIG. 13 is a left elevation view of a pole pivot, part of the adapter of FIG. 1.

When the fastener 214 is releasable, the fastener can be unthreaded from the nut 216 and withdrawn from the opening 236 in the pole pivot (FIGS. 13 and 15). The pole pivot can then be removed from the center pivot, rotated 180° about its longitudinal axis and reinserted into the center pivot. In this configuration, the non-circular cavity 232 formed in the pole pivot fits over and engages the noncircular boss 230 on the center pivot. In the illustrated examples, the noncircular cavity and the noncircular boss are both square or slightly trapezoidal profiles, for easy application, and the cavity 232 easily fits over the boss 230. In this configuration, the pole and pole pivot are pivotally locked relative to the axis defined by the fastener 214. Consequently, the pole only pivots about the pivot shaft 208. Even though the pole pivot and the center pivot are fixed relative to each other, the boss 230 adequately supports the cavity 232, and the arcuate cavity 228 is adequately supported on the circular boss 234. It should be understood that other geometric configurations are possible than the non-circular cavity and non-circular boss, but the non-circular geometry provides a relatively secure and reliable holding function, for example with long handles and large mop heads.

Where the fastener 214 is not removable, the original assembly will determine whether or not the pole pivot and the center pivot are permanently configured in a first configuration, for example universal pivoting in a hemisphere over 360°, or in a second configuration, with only 180° pivoting in a vertical plane perpendicular to the mop head 102. Alternatively, the original assembly can include a releasable fastener, which could be replaced by a fixed fastener, or a fixed fastener could be removed and replaced with a releasable fastener, with appropriate components.

The center pivot 210 includes a pivoting support portion 238 for supporting the center pivot as it pivots about the pivot shaft 208. The pivot support portion is partially semicircular or annular, and partially flat sided. The pivot support portion includes the respective front and back flanges 220 and 222 (FIGS. 10-12) and supports the flanges on the pivot shaft. The semicircular portion of the center pivot extends in a substantially circular shape with a substantially circular profile for contacting the pivot shaft from a first point 240 to a second point 242. The internal surface contacting the pivot shaft is substantially smooth and continuous. The semicircular portion 244 terminates at each side in substantially identical and facing flat surfaces 246. Both the semicircular and the flat surfaces extend the entire width of the center pivot. The flat surfaces help to apply compressive forces to the pivot shaft to help in holding the center pivot at a given angular position about the pivot shaft. Tightening or loosening the fastener 214 applies more or less pressure through the flat surfaces 246 specifically and the semicircular portion 244 generally, among other locations on the center pivot. Consequently, the fastener 214, when adjustable, can help to set the looseness or tightness of the adapter for pivoting about the pivot shaft 208.

Figure 3:
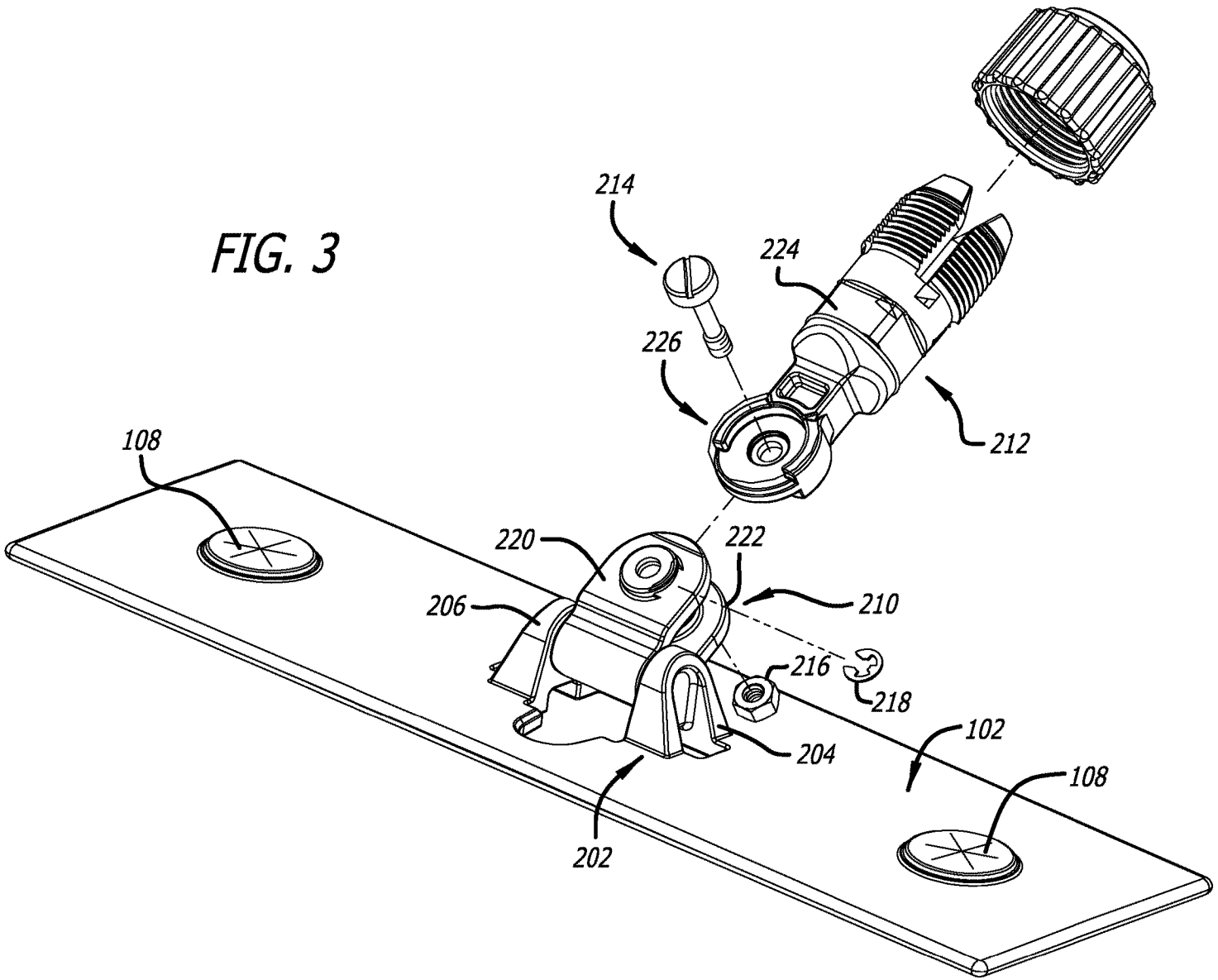
FIG. 3 is an exploded view of the assembly illustrated in FIG. 2.

After the flat surfaces 246, the walls of the center pivot diverge outwardly to the front and back flanges 220 and 222. The front and back flanges are substantially uniform in outside profile, and have approximately the same width and height. The front flange includes an external boss 248 against which the head of the fastener bears, and which receives the lock clip 218 (FIG. 3). The inside surface of the front flange includes the non-circular profile 230 having draft surfaces 250 and 252. An opening 254 is substantially centered in the non-circular profile 230, and is surrounded by a substantially circular boss 256 for engaging a complementary surface 258 or 260 on either side of the pole pivot 212 (FIGS. 13 and 15). A similar boss 262 is substantially centered about an opening 264 in the backside flange 222, and engages one or the other of the complementary surfaces 258 or 260 when the pole pivot is in position sandwiched between the front and back flanges 220 and 222 of the center pivot. The bosses 256 and 262 and the counter bores 258 and 260 help to support the pole pivot in the center pivot even without a fastener 214 having been secured. They also help to isolate parts from the captive fastener during normal rotation of the handle, and helping to minimize the tendency of an unthreading action.

The pole pivot 212 includes a substantially circular disk 266 supported at the bottom of the pole pivot shaft. The opening 236 extends completely through the circular disk. The counter bore 258 is formed into one side of the disc, and the counter bore 260 is formed into the other side of the disc. The noncircular cavity 232 is formed on the respective surface of the disc through substantially straight walls extending outward from the disk surface. The arcuate cavity 228 is formed on the oppositely-facing surface of the disk 266, and has a substantially semi-circular geometry. Walls defining the semicircular cavity extend outward from the respective surface of the disk 266, and terminate approximately at the level of the bottom of the counter bore 260.

Figure 16:
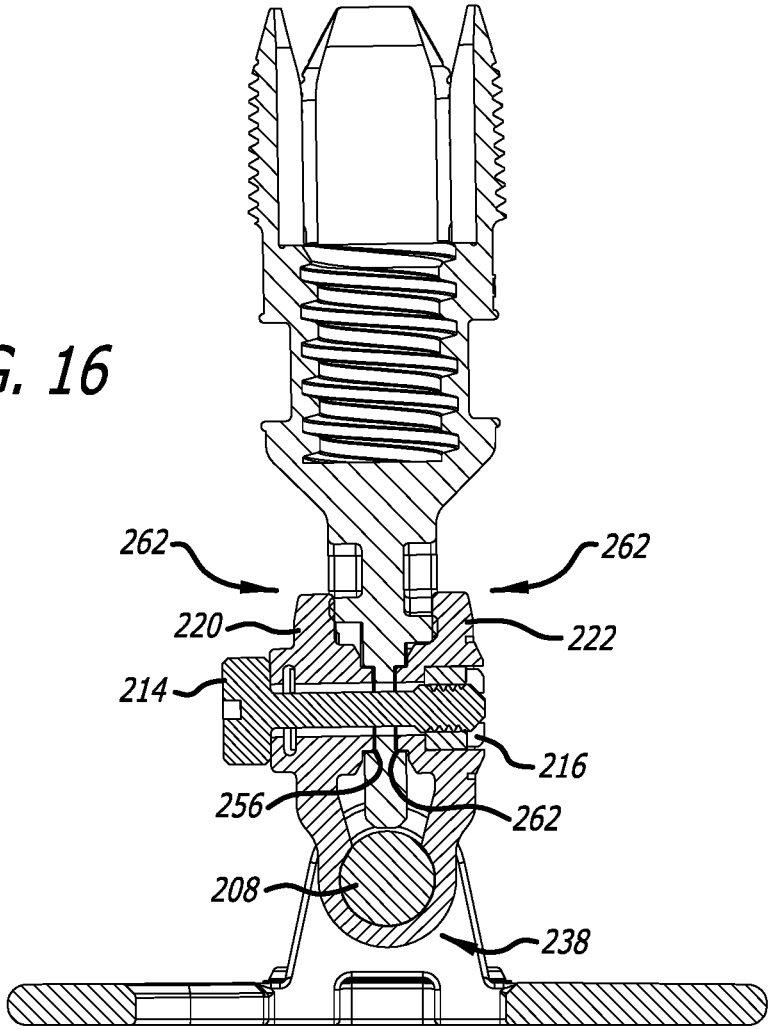
FIG. 16 is a longitudinal side cross section of the assembly taken along a line similar to a line 5-5 of FIG. 4.

When the center pivot, pole pivot and fastener are assembled, the circular portion of the pole pivot is inserted between the flanges of the center pivot (FIG. 16). Fastener 214 is secured by threading into the nut 216 until the desired tightness is reached for the pivoting components. As the tightening is initially begun, the center pivot and the pole pivot are configured such that the upper portions 262 of the flanges 220 and 222 bear more tightly against the adjacent surfaces of the pivot pole than do the bosses 256 and 262, and the semicircular pivot support 238. Consequently, loading or force is applied to a greater extent by the upper portions 262. As the fastener is tightened further, for example to tighten the pivoting motions, more loading or force is applied by the bosses 256 and 262, and also by the flat surfaces 246 about the pivot shaft 208. In this way, the single fastener 214 can be used to adjust the tightness of both pivoting actions, i.e. about the axis of the pivot shaft 208 and about the axis of the fastener 214.

The material of the pivot shaft, pole pivot and the center pivot may be formed from Delrin, or similar materials. It may also be talc filled polypropylene.

Having thus described several exemplary implementations, it will be apparent that various alterations and modifications can be made without departing from the concepts discussed herein. Such alterations and modifications, though not expressly described above, are nonetheless intended and implied to be within the spirit and scope of the inventions. Accordingly, the foregoing description is intended to be illustrative only.

What is claimed is:

1. A mophead assembly for a mop wherein the mophead assembly comprises:

a mophead extending longitudinally and configured for supporting a mop material;

a control adapter configured to receive a control element;

a mophead adapter supporting the mophead about a mophead pivot axis extending longitudinally relative to the mophead so that the mophead adapter and the mophead can pivot relative to each other about the mophead pivot axis, the mophead adapter including first and second spaced apart walls having facing surfaces forming a spacing between them, and wherein the mophead adapter includes a pivot element defining a control adapter pivot axis wherein the control adapter and mophead adapter are configured to pivot relative to each other about the control adapter pivot axis in a first configuration of the control adapter and wherein the mophead adapter and control adapter pivot only about the mophead pivot axis in a second configuration of the control adapter, wherein the control adapter includes a longitudinal axis intersecting the control adapter pivot axis and wherein positioning a component on the control adapter longitudinally of the control adapter longitudinal axis to extend between the spaced apart walls allows the control adapter and the mophead adapter to be placed in the second configuration.

2. The assembly of claim 1 wherein the spaced apart walls form a slot with a partly circular bottom.

3. The assembly of claim 1 wherein the spaced apart walls and component on the control adapter contact.

4. The assembly of claim 1 wherein the pivot element extends from one side of the mophead adapter to a second side of the mophead adapter.

5. The assembly of claim 4 wherein the pivot element is a fastener.

6. The assembly of claim 5 wherein the fastener is removable.

7. The assembly of claim 5 wherein the mophead adapter is configured with the fastener such that the fastener can tighten the spaced apart walls against the control adapter.

8. The assembly of claim 5 wherein the spaced apart walls are flexible.

9. The assembly of claim 1 wherein the mophead pivot axis and control adapter pivot axis do not intersect.

10. The assembly of claim 1 wherein in the first configuration the adapters permit movement of the mophead relative to the control adapter in a hemisphere.

11. The assembly of claim 1 wherein the first and second spaced apart walls include geometric surfaces facing each other, wherein the first spaced apart wall includes a non-circular surface, and the second spaced apart wall includes a circular surface.

12. The assembly of claim 1 wherein the control adapter includes first and second oppositely-facing surfaces wherein the first surface includes a non-circular geometry and the second surface includes a circular surface.

13. A mophead assembly for a mop wherein the mophead assembly comprises:

a mophead extending longitudinally and configured for supporting a mop material;

a pole pivot configured to receive a mop handle;

a mophead adapter movably supporting the mophead about a mophead pivot axis extending longitudinally relative to the mophead so that the mophead adapter and the mophead can pivot relative to each other about the mophead pivot axis, the mophead adapter including first and second spaced apart walls having facing surfaces forming a spacing with a partially circular bottom between them, and wherein the mophead adapter includes a shaft element defining a pole pivot pivoting axis wherein the pole pivot and mophead adapter are configured to pivot relative to each other about the pole pivot pivoting axis in a first configuration of the pole pivot and wherein the mophead adapter and pole pivot will pivot only about the mophead pivot axis in a second configuration of the pole pivot, wherein the pole pivot includes a longitudinal axis intersecting the shaft element and wherein positioning a component on the pole pivot longitudinally of the pole pivot longitudinal axis to extend between the spaced apart walls allows the pole pivot and the mophead adapter to be placed in the second configuration.

14. The assembly of claim 13 wherein the first and second spaced apart walls form a slot.

15. The assembly of claim 13 wherein the first and second spaced apart walls include facing surfaces and wherein the facing surfaces contact the component on the control adapter.

16. The assembly of claim 13 wherein the shaft element forms part of a fastener.

17. The assembly of claim 16 wherein the fastener is removable.

18. The assembly of claim 16 wherein the mop head adapter is configured with the faster such that the fastener can tighten the spaced apart walls against the pole pivot.

19. The assembly of claim 16 wherein the spaced apart walls are flexible.

20. The assembly of claim 13 wherein in the first configuration the pole pivot and the mop head can move in a hemisphere relative to each other.

21. The assembly of claim 13 wherein the first and second spaced apart walls include geometric surfaces facing each other, wherein the first spaced apart wall includes a non-circular surface, and the second spaced apart wall includes a circular surface.

22. The assembly of claim 13 wherein the component on the pole pivot includes first and second oppositely-facing surfaces wherein the first surface includes a non-circular geometry and the second surface includes a circular surface.

23. A mophead assembly for a mop wherein the mophead assembly comprises:

a mophead extending longitudinally and configured for supporting a mop material on a working surface of the mophead;

a control adapter configured to receive a mop handle;

a mophead adapter on a mophead surface opposite the working surface and supporting the mophead for movement about a mophead pivot axis extending longitudinally relative to the mophead so that the mophead adapter and the mophead can pivot relative to each other about the mophead pivot axis, the mophead adapter including first and second spaced apart walls extending parallel to each other and having facing surfaces forming a spacing between them and having a partially circular bottom, and wherein the mophead adapter includes a shaft element defining a control adapter pivot axis wherein the control adapter and mophead adapter are configured to pivot relative to each other about the control adapter pivot axis in a first configuration of the control adapter and wherein the mophead adapter and control adapter pivot only about the mophead pivot axis in a second configuration of the control adapter, wherein the control adapter includes a longitudinal axis intersecting the shaft element and wherein positioning a component on the control adapter longitudinally of the control adapter longitudinal axis to extend between the spaced apart walls allows the control adapter and the mophead adapter to be placed in the second configuration.

* * * * *